United States Patent [19]

Bock et al.

[11] Patent Number: 4,915,646

[45] Date of Patent: Apr. 10, 1990

[54] ELECTRICAL TRUNKLINE SYSTEM

[75] Inventors: Immo E. Bock, Randburg; Philip L. Nathan, Senderwood; Peter O. Malpage, Norwood, all of South Africa

[73] Assignee: Johannesburg Construction Corporation (Proprietary) Limited, Johannesburg, South Africa

[21] Appl. No.: 233,214

[22] Filed: Aug. 17, 1988

[30] Foreign Application Priority Data

Aug. 18, 1987 [ZA] South Africa ..... 87/6093

[51] Int. Cl.[4] ..... H01R 4/24

[52] U.S. Cl. ..... 439/425

[58] Field of Search ..... 439/67, 77, 391, 417, 439/418, 425, 426, 492, 499

[56] References Cited

U.S. PATENT DOCUMENTS 2,963,572 12/1960 Rullo ..... 439/425

3,745,228 7/1973 Vogt ..... 439/425

4,578,731 3/1986 Andriessen et al. ..... 439/425

*Primary Examiner*—Joseph H. McGlynn

*Attorney, Agent, or Firm*—Harness, Dickey & Pierce

[57] ABSTRACT

A trunkline has a multi-core ribbon cable with electronic modules mounted thereon at spaced intervals. The modules have pins which pass through preformed holes in the cable to make contact with the cores. The modules further have housings which seat in apertures in the cable. The modules are each retained in position by two clamping members which clip together with the module and adjacent ribbon sandwiched between them. Load devices, such as detonators are connected to the trunkline at desired positions therealong by connectors having staples that pierce the cable to make contact with the cores. Each staple is electrically connected to a core of a connecting wire by clamping the core against a base portion of the staple utilizing two plastic parts that clip together. One of these parts, in turn, is hinged to a further member which clips with the parts to clamp the cable between the parts and the further member.

9 Claims, 3 Drawing Sheets

ELECTRICAL TRUNKLINE SYSTEM

This invention relates to an electrical trunkline system. Such a system uses a trunkline comprising a multi core cable and electronic module to steer signals sequentially, or in some other predetermined manner, to a number of load elements. Such systems are utilized with sequential blasting, in which case the load elements are electric detonators. The invention extends further to a method of manufacturing the trunkline, to a connector for electrically connecting an electrical device to such trunkline or cable forming part thereof and the cable together with the connectors.

According to a first aspect of the invention there is provided an electrical tunkline, which includes a flat, ribbon-like cable having a plurality of conducting cores arranged next to and spaced from one another in a substantially planar manner with an electrically insulating material covering the cores and filling the spaces betwen them, and having a number of groups of hole at spaced positions along the length of the cable, each group comprising a plurality of holes each of which passes through a core and insulating material on one side thereof;

a plurality of electronic modules each of which has a plurality of pins, there being at least as many holes in each group as there are pins, with modules engaged with the cable at least some of the positions, the pins of each module passing through the holes in the cores at the position to make electrical contact with the cores; and a retaining means for retaining each of the modules on the cable with its pins in electical contact with the cores.

Further according to this aspect of the invention there is provided a method of manufacturing an electrical trunkline, which includes providing a flat, ribbon-like cable having a plurality of conducting cores arranged next to and sapced from one another in a substantially planar manner with an electrically insulating material covering the cores and filling the spaces between them;

forming groups of holes at spaced positions along the length fo the cable, each group comprising a plurality of holes each of which passes through a core and insulating material on one side thereof;

placing an electronic module having a plurality of pins on the cable at each position, with its pins in at least some of the holes such that the pins are in electrical contact with the cores; and retaining each of the modules on the cable with its pins in electrical contact with the cores.

At least one core may have a discontinuity at each position so that pieces of the core on either side of the discontinuity at each position are electrically isolated form one another. There may further be a hole at each end of each piece at each position, so that a module is connected to each piece at adjacent ends thereof. The discontinuities may be provided by means of gaps in the or each core which has the discontinuities. These gaps may be formed by removing material to leave an aperture in the cable. The aperture and the holes may conveniently be formed at the same time, in a punching operation. Thus, each group of holes will have the same pattern and configuration. Furthermore, a body portion of the module may be received in the aperture and may be of a similar size and shape to be a snug fit therein. In this way, the body portion assists in isolating the pieces of core on either side of the aperture and also in locating the module.

The module may be retained on the cable in a number of ways. In a preferred form, the module is clamped on the cable by means of a suitable clamping arrangement. In one embodiment, the clamping arrangement may have two parts which clip together with the cable and the module sandwiched between them. These parts may be moulded and may be joined by an integral hinge portion.

In a further preferred form, the cores may have a rectangular cross sectional profile with substantially flat upper and lower sides, the upper and lower sides being longer than the ends so that the cores are strip-like. Further, the holes may pass through the cores and through insulating material on both the top and bottom thereof.

It will be appreciated by those skilled in the art that each electronic module will have components and circuitry for steering electrical signals supplied, in use, along one of the cores from a signal generator connected to the cable at one end, to another one of the cores. In a preferred from, the cable has five cores, two of which (supply cores) are utilized to provide signals from the signal generator, two fo which (load cores) are utilized to supply signals to a load element such as a detonator, and one of which (an arming core) is utilized to supply arming signals from one module to the next.

The cable may further be divided into sections, so that a module in that section addresses the load cores of that section, and to isolate load cores of adjacent sections from one another. This may be effected by forming further discontinuities in the load cores. These discontinuities may also be provided by removing pieces of the cores at spaced positions along the length of the cable. These positions may be marked, and the gaps filled, by dividing plugs.

It will be appreciated that the modules and the dividing plugs are mounted on the cable during manufacture of the trunkline in a suitable manufacturing plant, and supplied to users in rolls or on reels with a suitable length of the trunkline being removed and used as desired.

Further according to the invention there is provided a connector for electrically connecting an electrical device to a cable at any desired position along its length, the cable being flat and ribbon-like and having a plurality of conducting cores arranged next to and spaced from one another in a substantially planar manner with an electrically insulating material covering the cores and filling the spaces between them, which includes a first member and a second member which have complementary locking formations for locking the members together, with the cable being receivable between the members;

at least one staple-like piercing and contacting element carried by the first member for piercing the insulating material and making electrical contact with a selected one of the cores; and a length of wire having one end electrically connected to the piercing and contacting element.

The piercing and contacting element may be "U"-shaped, having two legs and a base portion, with the wire being connected to the base portion. In a preferred form, the wire is mechanically clamped to the base portion. For this purpose, the first member may have two parts, with the base portion and the wire of the element being clamped between these parts.

As such a connector will normally need to have two wires, it will, in most cases, have two wires and two elements, one wire being connected to one element and the other wire to the other element.

In the same way that the wires and elements are clamped together, the two members may clip together with the cable sandwiched between them. For this purpose, at least one member may have a clip engageable with the other.

To facilitate storage and use, the two members may be hingedly connected along a hinge region, and the two parts of the first member may similarly be hinged together along a hinge region. The said parts and members may be of a suitable synthetic plastics material and may be moulded in a suitable mould.

A load device may be electrically connected to the wires at their ends remote from the elements. As indicated above, in a particular application, the load devices may be electrical detonators.

Although this aspect of the invention is directed primarily to the connector itself, it is also directed to the cable in combination with the connectors, and to a cable which has the connectors engaged therewith, in use. Further, as indicated above, a particular use may be for blasting, in which case the cable together with modules forms a trunkline, and with the connectors engaged therewith forms an electrical sequential blasting arrangement.

The invention is now described, by way of an example, with reference to the accompanying drawings, in which.

Figure 1:
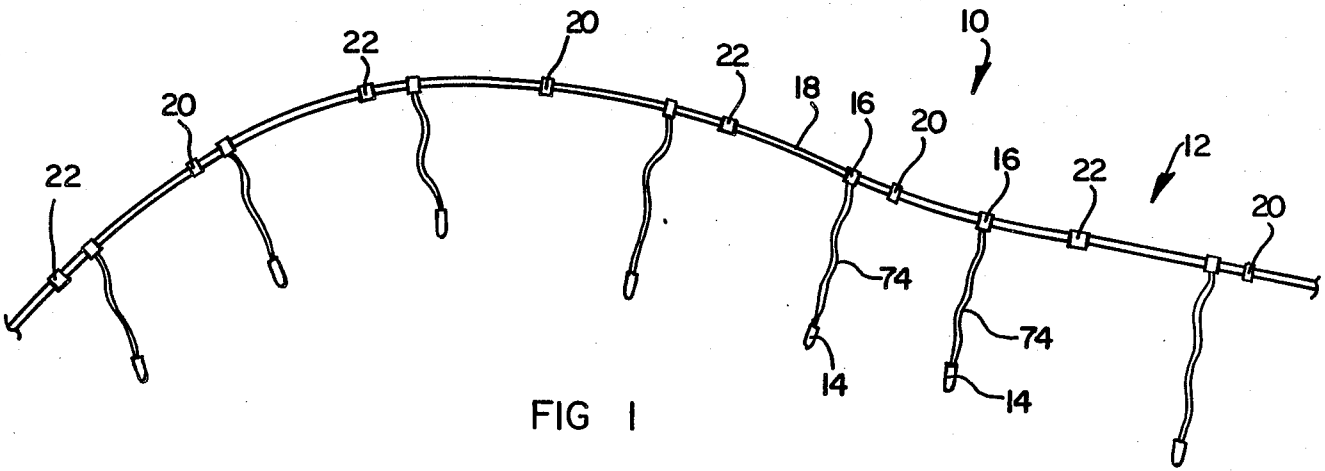
FIG. 1 shows schematically a sequential blasting arrangement in accordance with the invention, which utilizes a trunkline in accordance with the invention and connectors in accordance with the invention.

Referring to FIG. 1, a part of a sequential blasting arrangement is shown therein, designated generally by reference numeral 10. The arrangement 10 utilizes an electrical trunkline 12 which has a number of electrical detonators 14 connected thereto by means of connectors 16. The trunkline 12 utilizes a five-core cable 18 which is divided into sections by means of dividing plugs 20. In each section of the cable 18, there is an electronic steering module 22. In use, initiating signals are supplied from a signal generator in the form of a shot exploder (not shown) that is connected to the trunkline 12 at one end thereof. The first of such signals is steered by a last module 22, which has been manually armed, to the last detonator 14. Successive signals are then successively steered by the modules 22 to the other detonators 14, until all the detonators 14 have been sequentially initiated with a predetermined time interval between the initiation of successive detonators 14.

Figure 2:
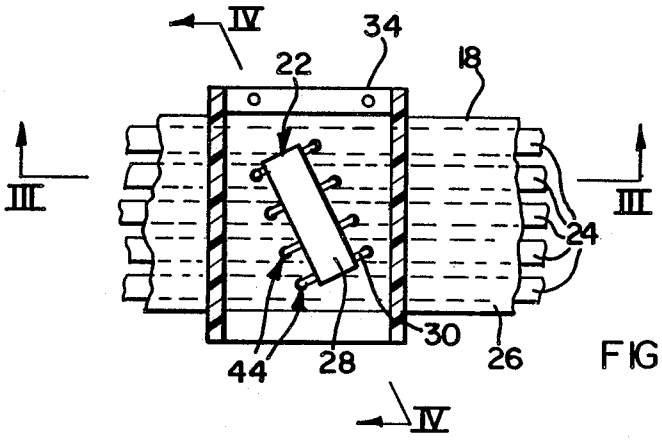
FIG. 2 shows a partly sectioned view of part of the trunkline shown in FIG. 1, illustrating in more detail how an electronic steering module is mounted on cable of the trunkline.
Figure 3:
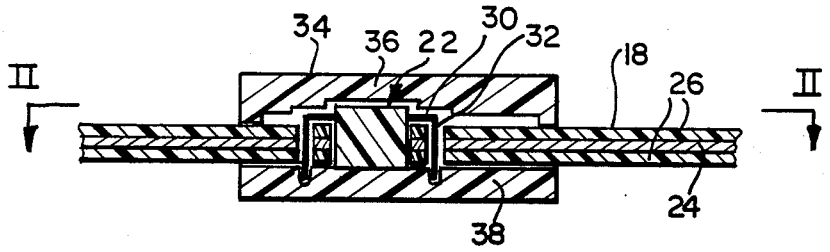
FIG. 3 is a further sectioned view of this part of the trunkline, along line III—III in FIG. 2.
Figure 4:
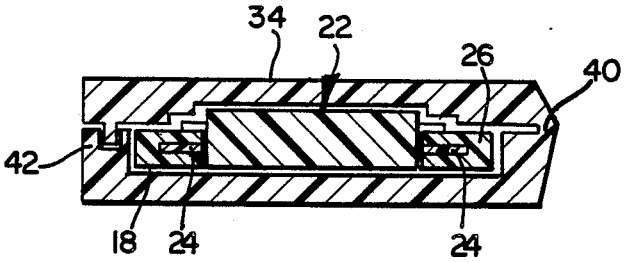
FIG. 4 is a further sectioned view of this part of the trunkline along line VI—VI in FIG. 2.

Referring to FIGS. 2, 3 and 4, the manner in which the modules 22 are mounted on the cable 18 is shown in more detail. Thus, the cable 18 has five copper cores 24 which are substantially flat and rectangular and are arranged next to one another with electrically insulating material 26 covering the cores and filling the spaces between them to provide a flat ribbon-like cable 18.

In the particular embodiment shown in the drawings, the two outer cores 24 are supply cores utilized to supply signals to the module 22 from the shot exploder, the middle core 24 is an arming core and is utilized to supply arming signals from one module 22 to the other and the two intermediate cores, one on either side of the middle core, are load cores and are utilized to supply initiating signals to the detonators 14.

Each module 22 is in the form of an integrated circuit, having a housing 28 with eight legs 30 extending therefrom, four on each side, with each leg 30 having a pin 32 at its free end.

It will be appreciated that the modules 22 are spacedapart along the length of the cable 12, the spacing being dependent on the particular application. Intermediate the modules 22 are the dividing plugs 20. The spacing between the modules 22, between the plugs 20 and between the modules 22 and the plugs 20 is predetermined during manufacture of the trunkline 12 in a suitable factory. Thus, the trunkline 12 in the form of the cable 18 with the modules 22 and plugs 20 mounted thereon is supplied in reels or rolls and a suitable length of the trunkline 12 is utilized as desired. The connectors 16 are connected to the trunkline 12, in situ, and are engaged with the cable 18 at any desired points between the modules 22 and the plugs 20. As indicated in FIG. 1, two connector 16 are engaged with each section of cable, with a connector 16 on either side of each module 22, between the module 22 and its adjacent dividers 20.

Thus, the when the trunkline 12 is manufactured, the modules 22 are mounted on the cable at the appropriate positions, and are retained on the cable 18 by means of clamping units 34. Each clamping unit 34 has a top member 36 and a bottom member 38. As is clearly seen in FIGS. 3 and 4, each clamping unit 34 clamps its module 22 and adjacent cable 18 between its top and bottom members 36, 38. The bottom member 38 has a suitable recess in which the cable 18 is seated, wtih the top member having suitable recesses to locate and grip the housing 28. Further, the top and bottom members 36, 38 are moulded from a suitable synthetic plastic material in integral form, being connected by a hinge portion 40. The top and bottom members 36, 38 are locked together by means of pins 42, if necessary with the use of an adhesive.

Further, as is seen clearly in FIGS. 3 and 4, a rectangular aperture is formed in the cable 18 at each position at a slight angle to a longitudinal axis of the cable 18, the aperture being of a suitable size to receive the housing 22 in a sung manner. It will be appreciated that, at each position, a piece of the middle arming core 24 and of the adjacent load cores 24 is removed, together with insulating material on top and bottom and between these cores 24, to provide pieces of these cores 24 on either side of each aperture. Further, eight holes 44 are formed in the cable 18 at each position, four on either side of each aperture. Each hole 44 passes through the cable 18 from top to bottom, passing through the insulating material on top and bottom and the core 24 between. As is seen in FIG. 2, one hole is formed in each of the outer supply cores 24, and one hole 44 is provided at the ends of the pieces of arming and load cores 24 on either side of the aperture. The holes 44 will be in a suitable pattern and configuration which conforms with the pattern and configuration of the pins 32 and are of a suitable size so that the pins 32 are received therein with the pins 32 making good electrical contact with the cores 24. The apertures and the holes 44 are formed simultaneously, by a punching operation.

It will accordingly be appreciated, that the tunkline 12 is manufactured by providing a length of cable, punching the apertures and holes 44 at the predetermined positions, taking a module 22 and inserting its pins 32 into the holes 44 with its housing 28 entering the associated aperture, and clamping each module 22 in position on the cable with a clampng unit 34.

Figure 8:
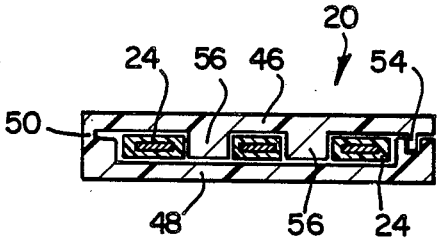
FIG. 8 shows a sectioned view of a still further part of the trunkline, illustrating in more detail a dividing plug and how the cable is divided into sections.

Referring further, at this stage to FIG. 8 it will be noted that each plug 20 also has a top member 46 and a bottom member 48 that are integrally moulded with a hinge region 50 and locking pins 54. Further, the top member 46 of the plug 20 has pegs 56. These pegs 56 are received in apertures that are punched in the load cores 24 to isolate the load cores 24 of adjacent sections of the cable 18 as is described above. The plugs 20 are mounted on the cable 18 with the pegs 56 in these apertures, in order to demarcate the sections of the trunkline 12 and to minimize the possibility of unwanted material forming an electrical bridge between adjacent piece of the load cores 24.

Figure 5:
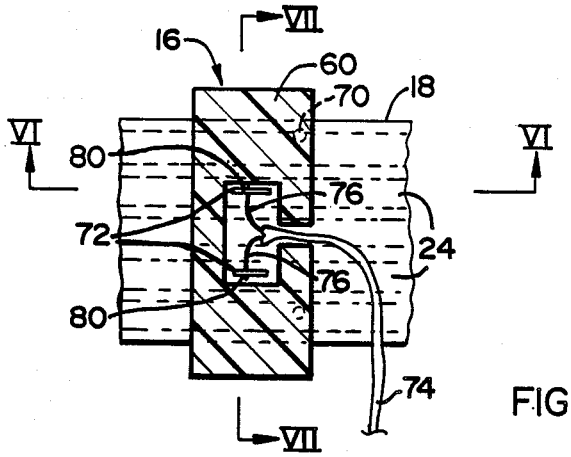
FIG. 5 is a sectioned view of a further part of the trunkline, illustrating a connector and how it is connected to the trunkline.
Figure 6:
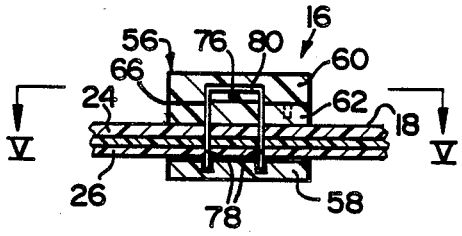
FIG. 6 shows a further sectioned view of this part of the trunkline, along line VI—VI in FIG. 5.
Figure 7:
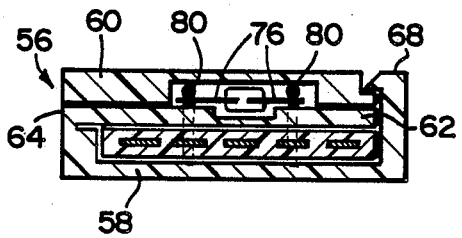
FIG. 7 shows a further sectioned view of this part of the trunkline, along line VII—VII in FIG. 5.

Referring now to FIGS. 5, 6 and 7, the connectors 16 and the manner in which they engage the cable 18 is shown in more detail. Thus, each connector 16 comprises a top member 56 and a bottom member 58. The top member 56 in turn, comprises two parts—an upper part 60 and a lower part 62. The bottom member 58 and the two parts 60 and 62 of the top member 56 are moulded from a suitable synthetic plastics material in a suitable mould (not shown). Thus, the top and bottom members 56 and 58 are hingedly connected, by means of a hinge region 64 which connects the bottom member 58 to the bottom part 62; and the top and bottom part 60, 62 are connected by means of a hinge region 66. Further, the top and bottom members 56, 58 clip together by means of a clip 68 and the top and bottom part 60, 62 lock together by means of pins 70.

Further, each connector 16 has two metal staples 72 and a length of two-core wire 74. The wire 74 has two conducting cores 76 that are connected at one end to the staples 72 and at the other ends to detonators 14. As is seen in these drawings, each staple 72 has two legs 78 and a base portion 80. The wires 76 are clamped between the base portion 80 of its staple 72 and material of the top and bottom parts 60, 62. Thus, each bottom part 62 has two pairs of holes in appropriate positions through which the legs 78 of the staples 72 pass, with the conducting cores 76 of the wire 74 being held between the base portions 80 and the material of the bottom part 62 between the appropriate holes, with the top part 62 pressing down on the base portions 80 to clamp the conducting cores 76 of the wire 74 in suitably good electrical contact with the base portions 80.

It will be appreciated that the connectors 60 are supplied with the top and bottom part 60 and 62 locked together with the cores 76 of the wire 74 and the wire 74 clamped in position, with the free ends of the legs 78 projecting from the bottom part 62.

Thus, to use the connector 16 the top member 56 with the legs 78 of the staples 72 projecting therefrom is placed in the appropriate desired position on the cable 18 with the staples 72 aligned with load cores 24 and the top member 56 is pushed towards the cable 18 to force the legs 78 of the staples 72 through the insulating material 26 on top of the cores 24, through the cores 24 and the insulating material 26 below the cores 24, so that the legs 80 are in electrical contact with the cores 24. The legs 78 may be sharpened to facilitate piercing of the cable 18. The bottom member 58 is then hinged around the cable 18 and the members 56 and 58 clipped together to retain the connector 16 in position and in electrical contact with the cable 18.

It will be appreciated that the bottom member 58 has a suitable recess in which the cable 18 is received and the top and bottom parts 60 and 62 have suitable recesses for the staples 72, the cores 76 and the wire 74. Further suitable rib formations may be provided to grip the cores 76 and the wire 74.

We claim:

1. An electrical trunkline, which includes a flat, ribbon-like cable having a plurality of conducting cores arranged next to and spaced from one another in a substantially planar manner with an electrically insulating material covering the cores and filling the spaces between them, and having a number of groups of holes at spaced positions along the length of the cable, each group comprising a plurality of holes each of which passes through a core and insulating material on one side thereof;

a plurality of electronic modules each of which has a plurality of pins, there being at least as many holes in each group as there are pins, with modules engaged with the cable at at least some of the positions, the pins of each module passing through the holes in the cores at that position to make electrical contact with the cores; and a retaining means for retaining each of the modules on the cable with its pins in electrical contact with the cores.

2. The trunkline of claim 1, in which at least one core has a discontinuity at each position so that pieces of the core on either side of the discontinuity at each position are electrically isolated from one another and there is a hole at each end of each piece at each position.

3. The trunkline of claim 2, in which at least one discontinuity is provided by a gap in the core.

4. The trunkline of claim 1, in which at least one of the retaining means comprises a clamping arrangement for clamping its module on the cable.

5. The trunkline of claim 4, in which the clamping arrangement has two parts which clip together with the cable and the module sandwiched between them.

6. The trunkline of claim 5, in which the two parts are moulded and are joined by an integral hinge portion.

7. The trunkline of claim 1, in which the holes pass through the cores and through the insulating material on both the top and bottom thereof.

8. The trunkline of claim 1, in which each electronic module has steering components for steering a signal supplied, in use, along one of the cores from a signal generator connected to the cable at one end, to another one of the cores.

9. The trunkline of claim 1, in which each core has substantially flat upper and lower sides.

* * * * *

UNITED STATES PATENT AND TRADEMARK OFFICE

CERTIFICATE OF CORRECTION

PATENT NO. :4,915,646

DATED :April 10, 1990

INVENTOR(S) :Bock, et al

It is certified that error appears in the above-identified patent and that said Letters Patent is hereby corrected as shown below:

Column 1, line 16, "tunkline" should be --trunkline--.

Column 1, line 22, "hole" should be --holes--.

Column 1, line 29, after "at" insert --at--.

Column 1, line 31, "the" (first occurrence) should be --that--.

Column 1, line 40, "sapced" should be --spaced--.

Column 1, line 45, "fo" should be --of--.

Column 1, line 57, "form" should be --from--.

Column 2, line 26, "fo" should be --of--.

Column 4, line 26, "spacedapart" should be --spaced-apart--.

Column 4, line 42, after "Thus," delete "the".

Column 4, line 50, "wtih" should be --with--.

Column 4, line 53, "plastic" should be --plastics--.

Column 4, line 62, "sung" should be --snug--.

Column 5, line 14, "tunkline" should be --trunkline--.

Signed and Sealed this

Thirty-first Day of March, 1992

*Attest:*

HARRY F. MANBECK, JR.

*Attesting Officer*

*Commissioner of Patents and Trademarks*